United States Patent [19]

Malamoud

[11] 4,455,101

[45] Jun. 19, 1984

[54] WRITING INSTRUMENT HAVING A NON-ROTATABLE CAP FOR BARREL REMOVAL

[75] Inventor: Jean G. Malamoud, Saint Jorioz, France

[73] Assignee: S.T. Dupont, Paris, France

[21] Appl. No.: 278,530

[22] Filed: Jun. 29, 1981

Related U.S. Application Data

[63] Continuation of Ser. No. 73,154, Sep. 7, 1979, abandoned.

[30] Foreign Application Priority Data

Sep. 11, 1978 [FR] France ..... 78 25994

[51] Int. Cl.[3] ..... B43K 9/00; B43K 5/00

[52] U.S. Cl. ..... 401/243; 401/131; 401/202; 401/221; 401/251; 401/213; 401/258

[58] Field of Search ..... 401/243–247, 401/202, 132–135, 241, 249, 250, 251, 213, 222, 221, 258, 131, 124

[56] References Cited

U.S. PATENT DOCUMENTS

| | | | |
|---|---|---|---|
| 675,699 | 6/1901 | Wirt | 401/245 |
| 955,675 | 4/1910 | Morlan | 401/246 X |
| 2,453,491 | 11/1948 | Cardin | 401/244 |
| 2,456,602 | 12/1948 | Welsh | 401/251 X |
| 2,990,205 | 6/1961 | Weisser | 401/251 X |
| 3,463,323 | 8/1969 | Riepe | 401/131 X |
| 3,941,491 | 3/1976 | Mutschler | 401/243 |
| 3,990,801 | 11/1976 | Dietze | 401/243 |

FOREIGN PATENT DOCUMENTS

| | | | |
|---|---|---|---|
| 1089669 | 9/1960 | Fed. Rep. of Germany | 401/246 |
| 2450536 | 5/1975 | Fed. Rep. of Germany | 401/244 |
| 915924 | 11/1946 | France | 401/247 |
| 250087 | 8/1947 | Switzerland | 401/244 |
| 10931 | of 1905 | United Kingdom | 401/251 |
| 699524 | 11/1953 | United Kingdom | 401/249 |

*Primary Examiner*—Steven A. Bratlie
*Attorney, Agent, or Firm*—Robert A. Shack

[57] ABSTRACT

A writing instrument is described, which includes a writing assembly, a holder for an ink reservoir joined to the writing assembly, a removable barrel secured by rotation to the holder, and a removable cap which, in the closed position, fits over and protects the writing assembly. The cap and writing assembly are rotatably integrated in both rotational directions when the cap is in the closed position, so that removal of the barrel is effected simply by rotating the barrel relative to the cap without it being necessary to remove the cap and hold the writing assembly in the hand.

8 Claims, 2 Drawing Figures

WRITING INSTRUMENT HAVING A NON-ROTATABLE CAP FOR BARREL REMOVAL

This application is a continuation of application Ser. No. 073,154, filed Sept. 7, 1979, now abandoned.

BACKGROUND OF THE INVENTION

1. Field of the Invention

The present invention relates to writing instruments and is directed more particularly to writing instruments having a barrel enclosing an ink reservoir and a removable cap protecting a writing assembly.

2. Description of the Prior Art

In most writing instruments, when the ink reservoir must be refilled or replaced, it is necessary to remove the cap and then, holding the writing assembly with one hand and the barrel of the writing instrument with the other hand, to separate them, usually by unscrewing. With such designs requiring the user to hold the writing assembly, there is an obvious risk of ink stains on the hands.

With certain other writing instruments, however, it may not be necessary to remove the cap to change the reservoir. The end of the barrel remote from the writing assembly can be provided with a closed plug screwed to the barrel. When this plug is removed, the ink reservoir then becomes accessible for filling or replacement. In such writing instruments, it is not necessary to hold the writing assembly to unscrew the plug, since the barrel can be held with one hand and the plug to be removed, with the other. However, this provides access only to the inside rear part of the barrel.

SUMMARY OF THE INVENTION

Accordingly it is an object of the invention to provide a writing instrument in which it is neither necessary to remove the cap in order to remove the barrel completely, nor to hold the writing assembly with the hand.

A feature of the present invention is the provision of a writing instrument which includes a writing assembly, a holder for an ink reservoir joined to the writing assembly, a barrel removably secured by rotation to the holder, and a removable cap which, in the closed position, fits over and protects the writing assembly. Means are provided rotationally coupling the cap and the writing assembly when the cap is in the closed position, so that the barrel may be removed from the holder by relative rotation of the barrel and the cap when the cap is in closed position.

BRIEF DESCRIPTION OF THE DRAWING

Reference is made to the accompanying drawing in which is shown an illustrative embodiment of the invention, from which its novel features and advantages will be apparent.

DESCRIPTION OF A PREFERRED EMBODIMENT

Figure 1:
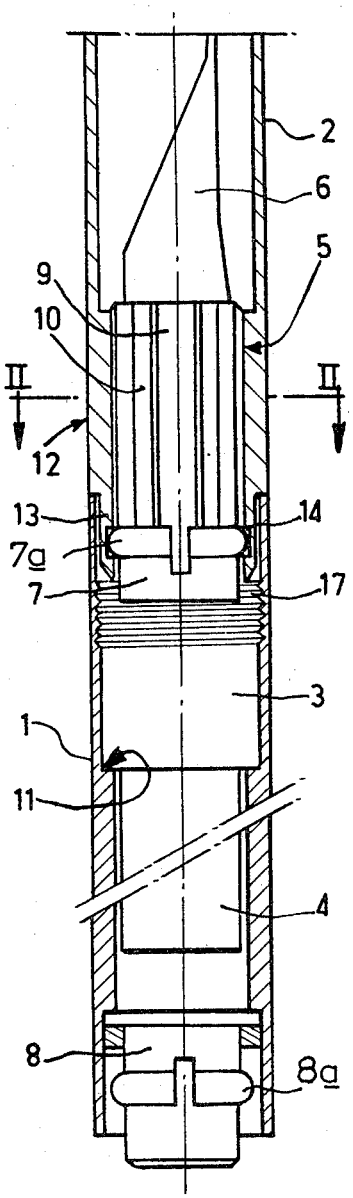
FIG. 1 is a lengthwise section through one embodiment of a writing instrument according to the present invention.
Figure 2:
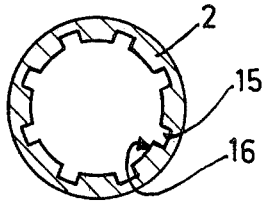
FIG. 2 is a section along line II—II of the cap of FIG. 1.

The writing instrument shown in the drawing is a fountain pen composed of a barrel 1 and a cap 2.

A holder or support 3 is screwed into barrel 1 and has joined thereto an ink reservoir 4 composed of a cartridge, a part 7 made of an elastically deformable material having an annular convexity indicated at *7a*, and a writing assembly comprising the end 5 of the pen body and a nib 6.

Holder 3 is held in position with respect to barrel 1 by the cooperation of a thread 17 and an inside shoulder 11 of the barrel 1.

An elastic part 8 identical to elastic part 7 and having a convexity indicated at *8a* is located at the end of barrel 1.

Pen body end 5 has, at its periphery, a number of longitudinal grooves 9 and tongues 10.

Cap 2 includes a zone 12 with an additional thickness and terminates in a narrowed end 13 having an internal circular groove 14 designed to cooperate with convex portions *7a* and *8a* of elastic parts 7 and 8 to hold the cap on the barrel either in the writing position or in the closed position.

Zone 12 has a series of longitudinal grooves 15 and tongues 16 which cooperate with tongues 10 and grooves 9 of pen body end 5 so that, when cap 2 is disposed on barrel 1 in the closed position, these parts mesh; and when cap 2 is turned, pen body end 5, holder 3, and cartridge 4 are together unscrewed, and barrel 1 can be withdrawn.

Hence this disassembly, which gives access to the entire ink reservoir and holder therefor, can be accomplished simply by holding the barrel and the cap, without it being necessary to hold the writing assembly with the hand.

It is to be understood that, without departing from the scope of the invention, various design details or arrangements may be modified with a view to obtaining the same result.

Thus, instead of connecting holder 3 and pen body end 5 in barrel 1 by screwing and abutting the inside shoulder, the lock could be of the quarter-turn type, for example the bayonet-type or the like.

Likewise, the grooves and tongues of the cap and pen body end 5 could be replaced by simple longitudinal flats, the essential point being the drive contact between, or the rotational integralization of, the pen body end and the cap. Thus it is sufficient if the contact surface between the cap and the writing assembly has at least one dihedral angle, the edge of which is substantially parallel to the axis of rotation of the cap.

What is claimed is:

1. A writing instrument comprising:

a writing assembly;

a holder for a renewable ink cartridge joined to said writing assembly, said holder being provided with an elastic annular radial projection;

a barrel removably secured to said holder by rotation;

a removable cap adapted in closed position to fit over and thereby cover and substantially seal said writing assembly from the ambient atmosphere, said cap being provided with an annular recess for engaging said annular radial projection provided on said holder and for thereby axially retaining said cap in said closed position against less than a given separation force; and means for rotationally locking said cap and said writing assembly in both rotational directions about the longitudinal axes of said cap and said writing assembly when said cap is in said closed position;

whereby said barrel may be removed from said holder for replacement of the ink cartridge without exposure of said writing assembly by relative rotation of said barrel and said cap when said cap is in said closed position.

2. A writing instrument according to claim 1, further comprising coupling means provided at the end of said barrel opposite said holder for receiving and retaining said cap on said opposite end of said barrel.

3. A writing instrument as in claim 2, wherein said coupling means includes means for aligning the outer surfaces of said cap and said barrel when said cap is coupled to said opposite end such that the axial profile lines of said coupled cap and barrel are substantially smooth, straight and continuous.

4. A writing instrument according to claim 3, wherein said coupling means comprises a recess formed in said opposite barrel end and a post mounted within said recess, said post being of substantially the same cross section as said holder and being provided with an elastic annular radial projection for coupling with said annular recess provided in said cap.

5. A writing instrument according to claim 4, in which said means for rotatably locking said cap and said writing assembly comprises a drive contact surface between said cap and said writing assembly.

6. A writing instrument according to claim 5, in which said drive contact surface has at least one dihedral angle, the edge of which is substantially parallel to the axis of rotation of said cap.

7. A writing instrument according to claim 5, in which said drive contact surface has at least one groove substantially parallel to the axis of rotation of said cap.

8. A writing instrument according to claim 7, in which said writing assembly comprises a pen body end to which a nib is attached, and said drive contact surface is disposed between the inside of said cap and the surface of said pen body end.

* * * * *